US008545130B2

(12) United States Patent
Harr

(10) Patent No.: US 8,545,130 B2
(45) Date of Patent: Oct. 1, 2013

(54) WICK ASSEMBLY AND METHOD FOR INSTALLING AN UNDERDRAIN

(71) Applicant: Harr Technologies, Inc., Anchorage, AK (US)

(72) Inventor: Robert E. Harr, Kasilof, AK (US)

(73) Assignee: Harr Technologies, Inc, Anchorage, AK (US)

( * ) Notice: Subject to any disclaimer, the term of this patent is extended or adjusted under 35 U.S.C. 154(b) by 0 days.

(21) Appl. No.: 13/665,456

(22) Filed: Oct. 31, 2012

(65) Prior Publication Data

US 2013/0058713 A1 Mar. 7, 2013

Related U.S. Application Data

(60) Division of application No. 11/640,782, filed on Dec. 18, 2006, now Pat. No. 8,303,215, which is a continuation-in-part of application No. 11/087,305, filed on Mar. 23, 2005, now abandoned.

(60) Provisional application No. 60/556,536, filed on Mar. 26, 2004.

(51) Int. Cl.
*E21B 11/00* (2006.01)

(52) U.S. Cl.
USPC ..... 405/39; 405/45

(58) Field of Classification Search
USPC ..... 405/39, 45, 43; 210/170.07
See application file for complete search history.

(56) References Cited

U.S. PATENT DOCUMENTS

| | | | | |
|---|---|---|---|---|
| 3,403,519 | A * | 10/1968 | Balko | 405/45 |
| 3,797,251 | A | 3/1974 | Shimizu | |
| 3,797,252 | A | 3/1974 | Ohtsuka | |
| 3,917,530 | A | 11/1975 | Boske | |
| 3,936,380 | A | 2/1976 | Boske | |
| 4,448,567 | A | 5/1984 | Tsuda | |
| 4,808,024 | A | 2/1989 | Haas | |
| 5,015,123 | A * | 5/1991 | Houck et al. | 405/45 |

(Continued)

FOREIGN PATENT DOCUMENTS

| | | | |
|---|---|---|---|
| CA | 2560509 | A1 | 10/2005 |
| WO | 2005/098141 | A2 | 10/2005 |

OTHER PUBLICATIONS

International Search Report of PCT Application No. PCT/US05/10073 filed on Mar. 25, 2005.

(Continued)

*Primary Examiner* — Gary Hartmann
(74) *Attorney, Agent, or Firm* — Dorsey & Whitney LLP

(57) ABSTRACT

A wick assembly for installation under a roadway according to the invention includes a perforated drain pipe, an inner sheet of a wicking fabric disposed on the perforated drain pipe in a manner effective to cover the perforations therein, an outer sheet of a wicking fabric, and a layer of filter aggregates confined between the inner and outer wicking fabric sheets to form a wick drain in combination with the perforated drain pipe. Water passes through the sheets and filter aggregates in order to enter the perforated drain pipe through the perforations therein. The wick drain may be disposed inside an outer pipe with the outer fabric sheet in slidable contact with the inner periphery of the pipe casing. The outer pipe casing serves to protect the wick drain during installation and is later removed once the wick drain is in position.

10 Claims, 3 Drawing Sheets

(56) References Cited

U.S. PATENT DOCUMENTS

| | | | | |
|---|---|---|---|---|
| 5,100,258 | A | 3/1992 | VanWagoner | |
| 5,378,357 | A | 1/1995 | Houck et al. | |
| 5,427,475 | A | 6/1995 | Coss | |
| 5,466,092 | A * | 11/1995 | Semenza et al. | 405/45 |
| 5,639,364 | A * | 6/1997 | Houck et al. | 210/170.01 |
| 5,836,716 | A | 11/1998 | Johnson et al. | |
| 6,068,426 | A | 5/2000 | Blanquet et al. | |
| 6,315,493 | B2 | 11/2001 | Malone et al. | |
| 6,443,652 | B1 | 9/2002 | Houck et al. | |
| 6,460,630 | B2 | 10/2002 | Ahtola et al. | |
| 6,527,477 | B1 | 3/2003 | Allard | |
| 6,641,335 | B1 | 11/2003 | Allard | |
| 6,705,800 | B2 * | 3/2004 | Ring et al. | 405/46 |
| 6,792,820 | B2 | 9/2004 | Wentworth et al. | |
| 6,854,924 | B2 | 2/2005 | Ring | |
| 6,955,190 | B2 | 10/2005 | Koerner | |
| 7,159,674 | B2 | 1/2007 | Egerstrom | |
| 7,736,091 | B2 | 6/2010 | Morizot et al. | |
| 7,931,423 | B2 * | 4/2011 | Bussey et al. | 405/45 |
| 8,251,611 | B2 * | 8/2012 | Bussey et al. | 405/45 |
| 8,256,990 | B2 * | 9/2012 | Koerner | 405/45 |
| 8,303,215 | B2 | 11/2012 | Harr | |
| 2004/0057797 | A1 | 3/2004 | Ring | |
| 2004/0218982 | A1 | 11/2004 | Wentworth et al. | |
| 2005/0214070 | A1 | 9/2005 | Harr | |
| 2007/0098500 | A1 | 5/2007 | Harr | |

OTHER PUBLICATIONS

Written Opinion of the International Searching Authority of PCT Application No. PCT/US05/10073 filed on Mar. 25, 2005.

* cited by examiner

WICK ASSEMBLY AND METHOD FOR INSTALLING AN UNDERDRAIN

This application is a divisional of Ser. No. 11/640,782, filed Dec. 18, 2006, which is a continuation-in-part of Ser. No. 11/087,305, filed Mar. 23, 2005, now abandoned, which claims the benefit of U.S. provisional patent application No. 60/556,536 filed Mar. 26, 2004.

TECHNICAL FIELD

This invention relates to methods and systems for the installation of underdrains beneath roads and other structures.

BACKGROUND OF THE INVENTION

Highways and other paved or concrete roadways can be damaged by water or other accumulated liquids under the roadway. The formation of bumps or frost heaves begins as water seeps under the roadway. As the water freezes and expands in cold weather, the resultant ice pushes up the roadway and forms bumps in the road. These road bumps require considerable cost and time to cut out the damaged areas and repave or reapply concrete. Further, such roadway repairs require additional costs in closing down traffic and providing traffic control.

Haas U.S. Pat. No. 4,808,024, Feb. 28, 1989, provides a method for installing a pavement underdrain wherein underdrains in the form of perforate pipes, preferably covered with a geotextile sock as a filter, are disposed transversely to the lengthwise direction of the roadway in close proximity to faults, cracks, joints and other fissures in the roadway. The underdrains conduct water away from such fissures thereby preventing roadbed particulate material from being pumped upwardly through the fissures together with water which collects below the concrete roadway. However, these underdrains have a relatively limited life in the field, such as 5 years or so, due to the, tendency for the filter fabric to become clogged. The present invention provides a wick drain having a much greater useful life, as well as a method for installing such a wick drain in situations where open cutting or trenching is impractical.

SUMMARY OF THE INVENTION

A wick assembly for installation under a roadway according to the invention includes a perforated drain pipe, an inner sheet of a wicking fabric disposed on the perforated drain pipe in a manner effective to cover the perforations therein, an outer sheet of a wicking fabric, and a layer of filter aggregates confined between the inner and outer wicking fabric sheets to form a wick drain in combination with the perforated drain pipe, such that water passes through the sheets and filter aggregates in order to enter the perforated drain pipe through the perforations therein. The wick drain may be disposed inside an outer pipe with the outer fabric sheet in slidable contact with the inner periphery of the pipe casing. As described further, the outer pipe casing serves to protect the wick drain during installation and is later removed once the wick drain is in position.

The invention further provides a method for installation of a wick drain in the ground. First, if necessary, a passageway is formed through the ground having an entry opening and an exit opening. A wick drain such as the one described above disposed inside a pipe casing is drawn into the passageway until the wick drain is positioned inside the passageway. Then the pipe casing is removed from the passageway by sliding it off of the wick drain, leaving the wick drain in the passageway in a position that allows accumulated liquids to be drawn into the wick drain and drain out of the passageway. The method can be used with a preexisting passageway, although most commonly a new passageway will be drilled using a directional drilling machine. To aid in removing the pipe casing while leaving the wick drain in place, it is preferred to secure the wick drain against lengthwise movement inside the passageway prior to removing the pipe casing, such as by tying it at one end to an anchoring object and pulling on the pipe casing from the other end.

The foregoing method can be practiced with a horizontal directional drilling machine such as the Vermeer Navigator. Using an HDD machine, a pilot hole is drilled from the entry opening to the exit opening, and a back reamer is then connected to the distal end of the drill string, which back reamer is in turn connected to the pipe casing. The HDD machine then pulls the back reamer and pipe casing with the wick drain inside. back through the pilot hole to fully form the passageway. If there is an existing pipe or drain in place, then the step of drilling the pilot hole is omitted, and the back reamer can be provided with pipe bursting capability so that existing pipe is burst as the pipe casing and wick drain are drawn in. One such pipe bursting pipe puller is described in Wentworth et al. U.S. Patent Publication 20040218982, Nov. 4, 2004, the contents of which are incorporated herein by reference.

The invention further relates to an underdrain for a railroad bed comprising a railroad track and bed on which the track is built. The underdrain includes an elongated perforate pipe for collecting water from the railroad bed, which, pipe is disposed in the railroad bed directly below the track and runs along the lengthwise direction of the track, preferably along the centerline of the bed or close to it. At least one outlet pipe is in communication with the perforate pipe, which outlet pipe extends laterally from the perforate pipe and has an outlet opening on one side of the railroad bed which conducts water from the underdrain out of the railroad bed. The invention further provides a method for installing the foregoing railroad underdrain using a directional drilling machine. This and other aspects of the invention are set forth in the detailed description which follows.

DETAILED DESCRIPTION

Figure 1:
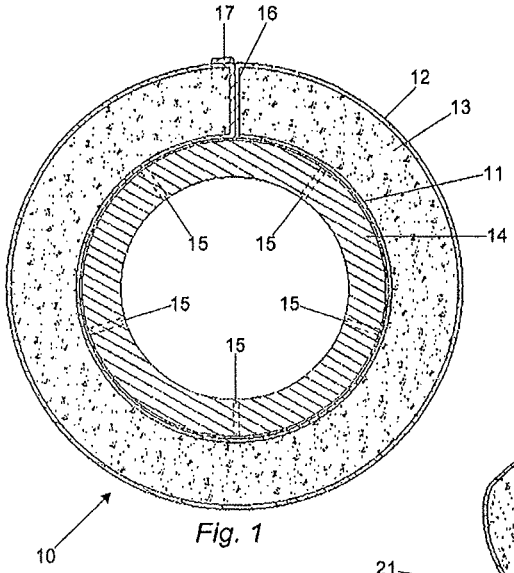
FIG. 1 is a cross section of a wick drain according to the invention.

FIG. 1 illustrates a wick drain 10 according to the invention. Wick 10 is formed by assembling inner and outer sheets 11, 12 with a layer of filter aggregate 13 in between. Sheets 11, 12 are preferably made of a rot-proof woven or non-woven fabric geotextile permeable to water but substantially impermeable to fines, i.e. soil particles. The filter materials 13 may include tire crumb rubber, a rock aggregate, ⅛" granular sand, a combination of these materials, and/or other suitable filter materials. The size of the filter material may be ⅜-inch chunks, for example. The multi-layer wick 10 may be loosely held together, sewn together, fabricated and/or fastened in a suitable manner. Wick 10 is then wrapped around a plastic drain pipe 14 having perforations 15 along its length to allow water to drain inside. Opposing side edges of wick 10 are sewn together, stapled, glued, bonded, or the like along its top margin 16. A suitable cord such as a length or rope or "mule tape" (nylon cord) 17 is also sewn into place along top margin 16 and has free ends 18 extending from each end of wick 10.

Figure 2:
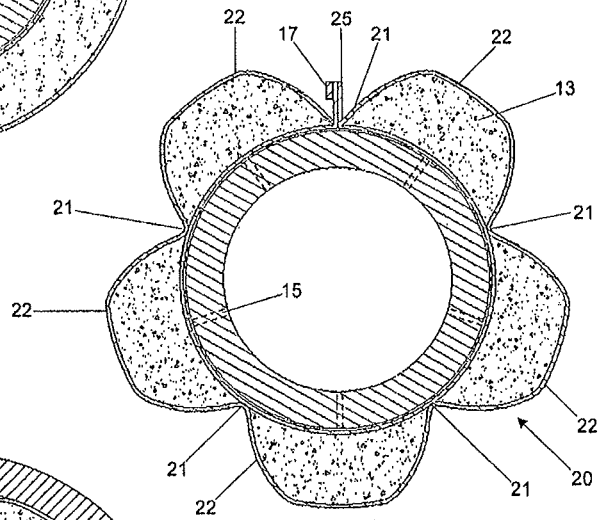
FIG. 2 is a cross section of a wick drain according to the invention wherein the aggregate layer has been subdivided into lobes.
Figure 3:
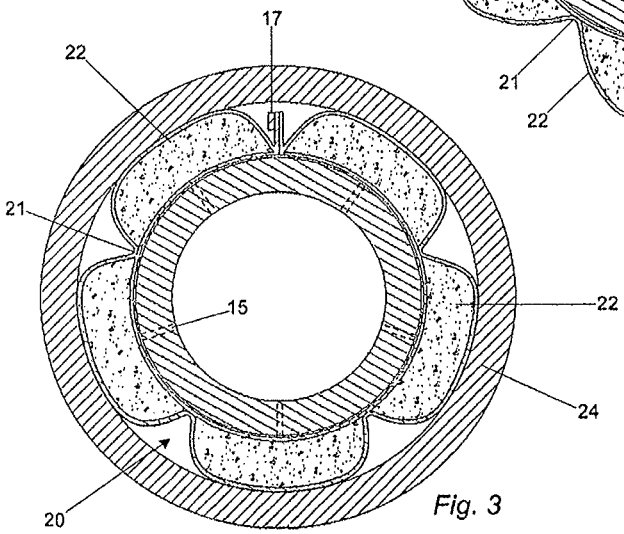
FIG. 3 is a cross section of the wick drain of FIG. 2 inserted inside a pipe casing prior to installation.

In a preferred form of a wick 20 according to the invention as shown in FIGS. 2-3, a series of seams 21 are sewn, stapled, or the like in a lengthwise direction to form five lobes 22 in cross section as shown. The lobed structure prevents the aggregate 13 from shifting down to the bottom during the fabrication of the wick or during the installation process. The extent to which this is a problem will vary depending on how the wick is handled during installation and the nature of the filter material. Other means for preventing settling of the filter material, such as a series of spaced apart, radially-extending screens or partitions subdividing the filter layer 13, may be used as well. Edges of extra material at opposite sides of outer sheet 12 are superposed and sewn together to form an outwardly extending flap 25 to which cord 17 is secured on one side.

FIG. 3 shows the wick 20 inserted inside an outer pipe or pipe casing 24 used during the installation of the hydraulic wick 20 as described below. Pipe 24 may be a 6⅛-inch high density polyethylene (HDPE) plastic pipe, for example. Pipe 24 is preferably not perforated so that, in the event the wick is installed through an area already saturated with water; the water will not start entering the wick drain until the wick drain is fully installed. Such water can greatly add to the weight of the assembly and cause breakage during installation. However, in areas where there is no risk of standing water entering wick drain 20 at the time of installation, it may be feasible to form perforations in outer casing 24 and leave it in place rather than pull it off of the wick drain. Pipe casing 24 also acts as a protective covering for the hydraulic wick which could otherwise become torn if pulled into a hole by itself. Wick 20 is secured along a pair of superposed edges forming a flap 26 to which the cord 17 is secured.

FIGS. 4-7 illustrate a method for installing a wick drain 10 or 20 according to the invention underneath a roadway 30. In a horizontal, double-ended drain installation, a horizontal directional drilling (HDD) machine 31 is used to drill a horizontal pilot hole 32 with a duckbill or Trihawk® bit at the desired location. Entry and exit openings 33, 34 may already be exposed on the shoulders of the roadway 30, as where roadway 30 has a pair of drainage ditches 36 on either side, or it may be necessary to dig entry and exit pits. A foaming agent, water or another fluid may be ejected from the bit to aid in drilling and float excess material out of the bore during drilling in a manner known in the art. At the end of the drilling step, a drill string 35 connected to HDD machine 31 emerges from exit opening 34.

A series of 20 foot sections of HDPE pipe are fused together end-to-end to the desired length to make the pipe casing 24, which preferably has a length which is about the same as the length of hole 32. A rope or nylon cord is blown through pipe 24 (or fed through by tying a weight to the end) and tied to one free end of cord 17. Wick 20 is then pulled inside casing 24 using the rope so that it assumes the position shown in FIG. 3. During this step, the lobes 21 of wick 20 contact the inner periphery of casing 24 and compress to some extent as shown. The foregoing steps are normally carried out to one side of the road near exit opening 34.

Figure 4:
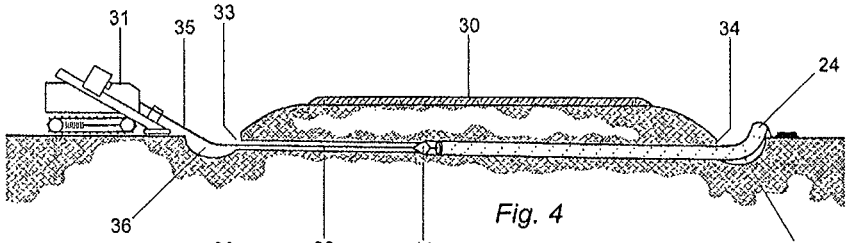
FIGS. 4-8 are a series of schematic diagrams illustrating a method of installing a wick drain according to the invention.

The drill bit is then removed and a back reamer 41 is mounted on the exposed end of the drill string 35 at exit opening 34. Casing 24 is attached thereto with any desired conventional pipe pulling accessory, such as a pipe pulling mesh that contracts on the outside of pipe casing 24 when pulled on. HDD machine 31 is then operated in pullback mode, whereby back reamer 41 passes along the length of the pilot hole 32 and widens it as shown in FIG. 4. The assembly of pipe casing 24 and wick 20 is pulled along behind reamer 41. For this purpose, casing 24 has the same or slightly smaller diameter than the greatest outer diameter of reamer 41. During this step, wick drain 20 stays inside pipe casing 24 due to its weight; it is not otherwise secured.

Figure 5:
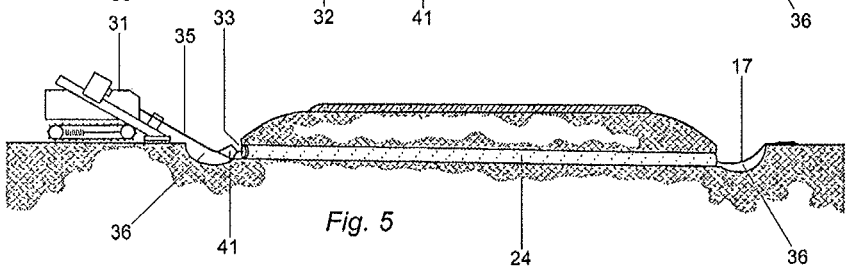
Figure 6:
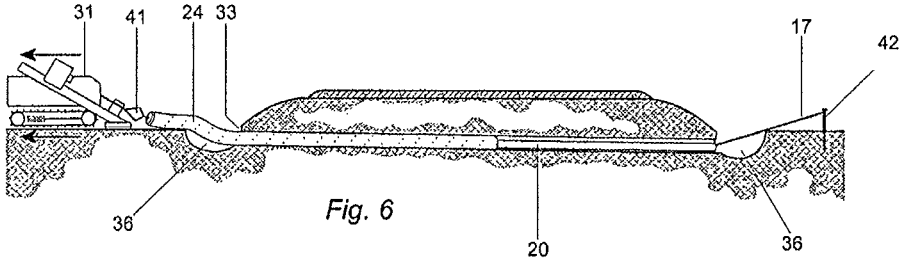
Figure 7:
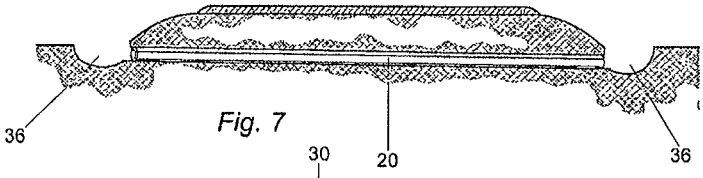

When the casing 24 and wick drain 20 are fully installed as shown in FIG. 5, back reamer 41 will have emerged from the original entry opening 33. At this stage, the rear free end of the sewn-in cord 17 is tied to an anchoring object 42 (tree, stake set in the ground, post, etc.) Pulling on casing 24 then continues, resulting in pulling the pipe casing 24 off of wick drain 20, leaving drain 20 in place in the bore. If back reamer 41 is not already at the HDD machine 31 at the end of the run, this can be done by continuing to pull back reamer 41 towards machine 31. Once back reamer 41 is fully retracted, HDD machine 31 itself (which is self-propelled on treads) backs away from entry opening 33 in order to continue pulling casing 24 out (see FIG. 6). This step could also be done manually by detaching casing 24 from reamer 41 and pulling on it with human workers, the feasibility of this depending on the length of pipe casing 24 and tightness of engagement between it and the soil. When casing 24 has been fully removed, wick drain 20 is fully installed as shown in FIG. 7. Exposed ends of cord 17 are removed and screens (not shown) may be placed over the exposed end openings of the wick drain 20. The lobed structure shown in the drawing having two geotextile layers with aggregate in between can last up to 100 years.

Figure 8:
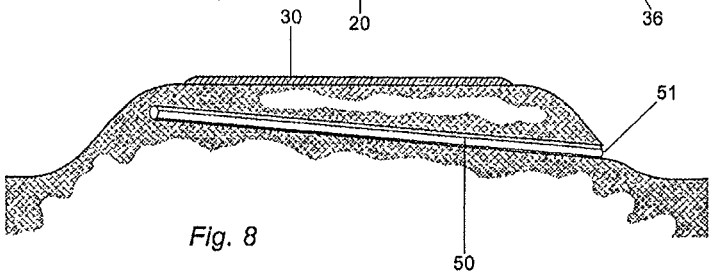

FIG. 8 shows a form of blind drain 50 installed using the same method as described above, except that the wick drain is at an angle so that water drains out of its exposed exit opening 51. Its entry opening may be left exposed and covered with a screen, or sealed off with a cap and the original entry hole 33 filled in above it, forming the blind drain 50.

The wick drain 10, 20 according to the invention remains in place under the roadway to draw any accumulated water and other liquids into the perforated drain pipe 14. The multi-layer materials 11-13 act like a wick to absorb, filter and conduct the liquids into drain pipe 14, which allows the collected liquids to be pulled by gravity and flow out of the exit point(s) of the drain. The filter materials 11-13 further prevent debris from clogging the perforated drain pipe 14 and ensures the proper operation of the hydraulic wick 20.

The hydraulic wick apparatus and method of the invention avoid the expense of cutting the highway, traffic control, and repaving or reapplying concrete to repair the roadway. The installation of the hydraulic wick may be performed while traffic is traveling on the roadway, therefore minimizing impact to traffic. Only limited traffic control is needed to ensure driver and road crew safety.

Figure 9:
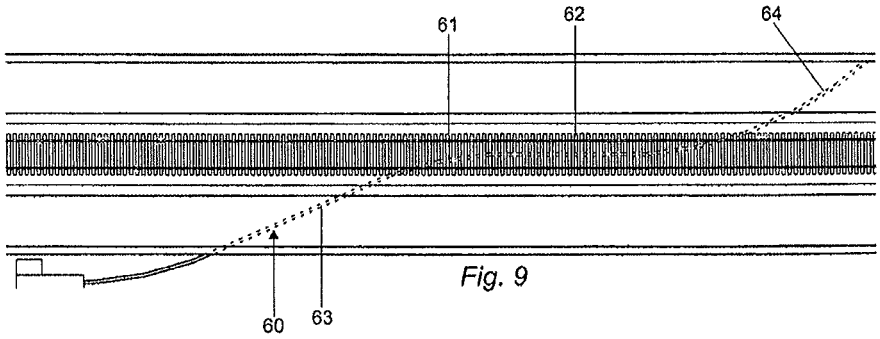
FIG. 9 is a top view of a railroad bed drain installation according to the invention.
Figure 10:
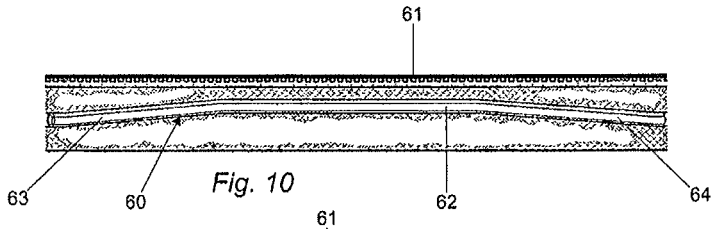
FIG. 10 is a side view of the installation shown in FIG. 9.
Figure 11:
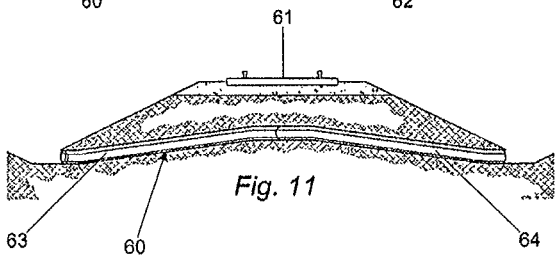
FIG. 11 is an end view of the installation shown in FIG. 9.

FIGS. 9 to 11 show a double-ended underdrain 60 formed beneath a raised railroad bed 61. For this type of installation, unlike the transverse underdrains used beneath roadways, it is efficient to collect water along the centerline of the railroad bed in an area where it tends to accumulate. For this purpose, drain 60 is generally z- or s-shaped, with a midsection 62 running along the centerline of the railroad bed 61, and a pair of end sections 63, 64 foaming outlet pipes angling downwardly from opposite ends of mid-section 62 and at obtuse angles relative to midsection 62. HDD machine 31 is used to steer at the junctures between sections, and pipe casing 24 has sufficient flexibility to follow the path shown, the method of installation otherwise being the same as that practiced for a roadway as described above. The actual dimensions can be varied from those shown to make drilling and reamer pullback easier. The underdrain may be a wick drain as described herein or a simpler form of drain, such as a perforate pipe by itself or covered with a geotextile sock as described in Haas U.S. Pat. No. 4,808,024, Feb. 28, 1989, the contents of which are incorporated by reference herein.

While the invention has been described with reference to illustrative embodiments, this description is not intended to be construed in a limiting sense. The aggregate could, for example, be filled into geotextile sleeves forming sandbags which are then wrapped around the inner perforate pipe side by side along its length, eliminating the need for long, quilted blanket having the same length as the perforate inner pipe. These sandbags could wrap all the way around the perforate pipe or only part way around, as long as the perforations are adequately covered. There and other modifications and combinations of the illustrative embodiments will be apparent to persons skilled in the art upon reference to the description. Such variations and additions are specifically contemplated to be with the scope of the invention. It is intended that the appended claims encompass any such modifications or embodiments.

The invention claimed is:

1. A wick assembly for installation under a roadway, comprising:

a perforated drain pipe;

a first sheet of a wicking fabric disposed on the perforated drain pipe in a manner effective to cover the perforations therein;

a second sheet of a wicking fabric;

a layer of filter aggregate disposed between the first and second wicking fabric sheets to form a wick drain in combination with the perforated drain pipe to allow water to pass through the sheets and filter aggregates in order to enter the perforated drain pipe through the perforations therein; and a plurality of lengthwise seams at which the first and second sheets are secured together, subdividing the layer of filter aggregate into a plurality of lobes.

2. The wick assembly of claim 1, further comprising a cord fastened to at least one end of the wick drain.

3. The wick assembly of claim 2, wherein the cord is secured to the outside of the outer sheet along its length, the cord having at least one free end for tying the wick drain to an anchoring object.

4. The wick assembly of claim 1, further comprising a pipe casing in which the wick drain is disposed with the second sheet of fabric in slidable contact with the inner periphery of the pipe casing.

5. The wick assembly of claim 4, wherein the pipe casing is free of radial perforations along its length.

6. The wick assembly of claim 1, wherein the filter aggregate includes rubber chunks, rock aggregate, sand, or combinations thereof.

7. The wick assembly of claim 1, wherein at least one of the first sheet of fabric or second sheet of fabric is made of a geotextile permeable to water but substantially impermeable to soil particles.

8. The wick assembly of claim 1, further comprising a pipe casing and wherein one or more of the lobes from the plurality of lobes contacts an inside of the pipe casing.

9. The wick assembly of claim 8, wherein the pipe casing is a high density polyethylene pipe.

10. The wick assembly of claim 1, further comprising a plurality of screens or partitions spaced apart from one another and extending radially through the filter aggregate.

* * * * *